United States Patent [19]

Farinacci et al.

[11] Patent Number: 4,656,919

[45] Date of Patent: Apr. 14, 1987

[54] SABOT/GUN GAS DIVERTER

[75] Inventors: Anthony L. Farinacci, Baldwin; Steven G. Witkin, Pikesville; Christopher J. Yaniger, Lutherville, all of Md.

[73] Assignee: The United States of America as represented by the Secretary of the Air Force, Washington, D.C.

[21] Appl. No.: 689,736

[22] Filed: Jan. 8, 1985

[51] Int. Cl.[4] ..... F41F 17/12

[52] U.S. Cl. ..... 89/14.6; 89/37.16

[58] Field of Search ..... 89/37.16, 12, 14.6

[56] References Cited

U.S. PATENT DOCUMENTS

| | | | |
|---|---|---|---|
| 868,938 | 10/1907 | Puff | 89/14.6 |
| 2,115,028 | 4/1938 | Logan | 89/14.6 |
| 2,811,901 | 11/1957 | Barr | 89/14.6 |
| 3,533,325 | 10/1970 | Barr | 89/14 |
| 3,665,861 | 5/1972 | Jaslow | 102/93 |
| 3,714,900 | 2/1973 | Feldmann | 102/93 |
| 4,022,103 | 5/1977 | Schmidt | 89/14 |
| 4,534,265 | 8/1985 | Bates et al. | 89/14.6 |

FOREIGN PATENT DOCUMENTS

| | | | |
|---|---|---|---|
| 124779 | 4/1919 | United Kingdom | 89/14.6 |

*Primary Examiner*—Harold D. Whitehead

*Attorney, Agent, or Firm*—Donald J. Singer; Bobby D. Scearce

[57] ABSTRACT

An improved sabot fragment and gun gas diverter of particular utility in conjunction with a rotatable multiple barrel gun is described, which comprises, a diverter member mounted forward of the barrels for rotation therewith and defining a generally conical, radially outwardly divergent impact surface from which sabot fragments are diverted outwardly upon impact thereon; a plurality of axial bores through and spaced around the diverter member correspond in number to and are respectively coaxial with the rotatable gun barrels; an impact surface is attached to the gun forward of the diverter member for diverting the fragments from the gun in a predetermined direction relative to the gun; a housing around the diverter member defining an internal chamber into which the fragments are diverted from the diverter member may include the impact surface as a forward end wall thereof, and may include an exit port for passage of fired projectiles and discharge ports for discharging diverted sabot fragments.

14 Claims, 5 Drawing Figures

SABOT/GUN GAS DIVERTER

RIGHTS OF THE GOVERNMENT

The invention described herein may be manufactured and used by or for the Government of the United States for all governmental purposes without the payment of any royalty.

BACKGROUND OF THE INVENTION

The present invention relates generally to improvements in devices for stripping sabots from a projectile and discharging the fragments thereof, and more particularly to a novel sabot fragment and gun gas diverter for use in conjunction with a rapid fire multiple barrel rotary gun.

In order to improve the armor penetration capabilities of existing gun systems, subcaliber sabotted penetrators exhibiting low aerodynamic drag have proved to be very effective. Typically, few problems are associated with discarded sabots from a ground based gun. However, on a forward firing aircraft, the possibility of ingesting both sabot fragments and gun gases into the engine(s) exists since the aircraft passes through the air space into which the gun gas and sabot fragments are discarded. Additionally, in systems such as the GAU-8 gun system used on the A-10 aircraft, impact damage to the aircraft structure, to wing-mounted weapon systems, and to belly-mounted electronics packages may require a device to divert the materials away from the aircraft structure.

In an existing system, a 20 mm sabot diverter compatible with the M-61 gun system consists of a rotary diverter attached to the muzzle section of the gun and rotatable with the barrels as the gun fires, which stops and pulverizes sabot fragments from a projectile and diverts them rearwardly. This type of diverter is not suitable for use on an aircraft such as the A-10 where the gun is directly in the nose of the fuselage and the engines are mounted far aft of the gun.

The present invention provides a sabot fragment and gun gas diverter including a starwheel and impact plate configuration for use in a forwardly mounted and forwardly firing gun system, such as the GAU-8 system. This configuration obtains its diversion characteristics within a minimum weight package by using a two-stage deflection operation. The first stage comprises a deflector which rotates with the gun barrels and deflects sabot fragments against an inclined impact plate comprising the second stage. The impact plate is fixed relative to the aircraft and redirects the fragments in a predetermined direction away from the aircraft clear of engine intakes and other aircraft structure. In order for the discarded material to be ejected clear of the aircraft, a maximum of sabot fragment momentum is conserved and maximum size of the diverted fragments is retained. The gun gas diversion characteristics of the diverter aid in flushing the sabot fragments from the diverter while maximizing velocity of the fragments.

It is, therefore, a principal object of the present invention to provide an improved device for diverting sabot fragments stripped from sabotted projectiles.

It is a further object of the invention to provide an improved sabot fragment diverter for use in conjunction with a multiple barrel, forward firing gun installation aboard an aircraft.

These and other objects of the present invention will become apparent as the detailed description of certain representative embodiments thereof proceeds.

SUMMARY OF THE INVENTION

In accordance with the foregoing principles and objects of the present invention, an improved sabot fragment and gun gas diverter of particular utility in conjunction with a rotatable multiple barrel gun is described, which comprises, a diverter member mounted forward of the barrels for rotation therewith and defining a generally conical, radially outwardly divergent impact surface from which sabot fragments are diverted outwardly upon impact thereon; a plurality of axial bores through and spaced around the diverter member correspond in number to and are respectively coaxial with the rotatable gun barrels; an impact surface is attached to the gun forward of the diverter member for diverting the fragments from the gun in a predetermined direction relative to the gun; a housing around the diverter member defining an internal chamber into which the fragments are diverted from the diverter member may include the impact surface as a forward end wall thereof, and may include an exit port for passage of fired projectiles and discharge ports for discharging diverted sabot fragments.

DESCRIPTION OF THE DRAWINGS

The present invention will be more clearly understood from the following detailed description of certain representative embodiments thereof read in conjunction with the accompanying drawings wherein.

DETAILED DESCRIPTION

Figure 1:
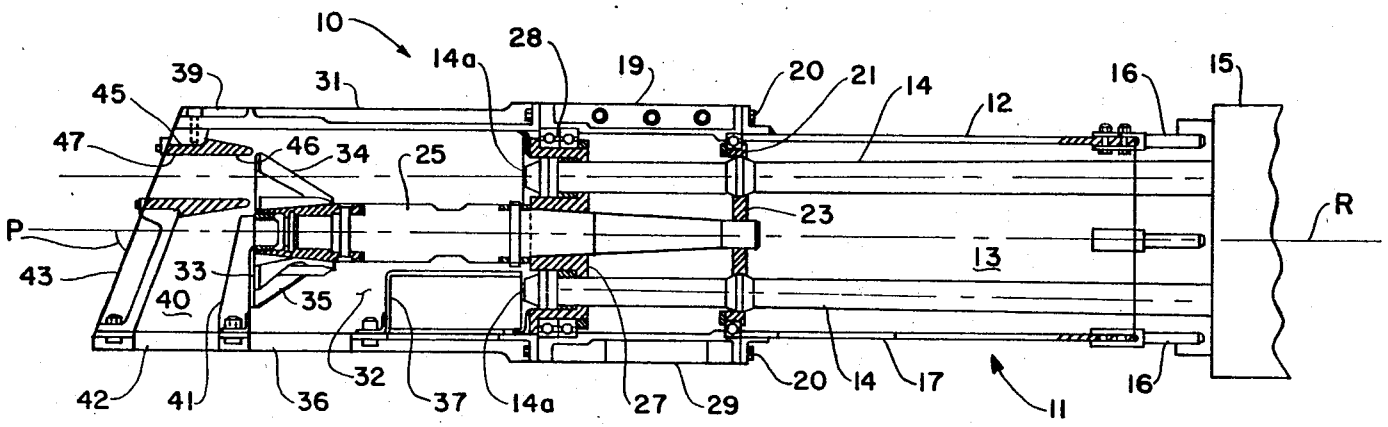
FIG. 1 is a view in axial section of the components of a representative sabot fragment and gun gas diverter of the invention.

Referring now to FIG. 1, shown therein is a view in axial section of the components of a representative configuration for the sabot fragment and gun gas diverter of the present invention. In the embodiment illustrated in FIG. 1, diverter assembly 10 is configured for use with a gun system 11 such as the GAU-8/A gun used on the A-10 aircraft. Accordingly, gun system 11 may be of the type including a housing portion in the form of a torque tube 12 defining a first chamber 13 containing a plurality of rotatable gun barrels 14 (e.g., seven barrels for the 30 mm GAU-8/A gun). Torque tube 12 may be attached at one end to the carrying vehicle, or other gun emplacement having a gun mount 15, through a plurality of torque mount pins 16 which support torque tube 12 coaxially with the receiver (not shown) of gun system 11. Torque pins 16 prevent torque tube 12 from rotating as the gun barrel 14 group rotates, but may slide axially within gun mount 15 to allow for recoil. Air ports 17 may be provided in torque tube 12 to provide air cooling to barrels 14.

A bearing housing 19 is supported at the forward end of torque tube 12 to rotatable support barrels 14 near the muzzle 14*a* ends thereof and to provide for the transfer of torque, impact and recoil loads from the diverter. Accordingly, bearing housing 19 may be secured to torque tube 12 via a plurality of conventional attaching bolts 20 or the like. A radial bearing 21 is rotatably supported within bearing housing 19 adjacent the forward end of torque tube 12 and carries a support plate 23 supporting barrels 14 for rotation about assembly axis R. Support plate 23 also carries one end of a support shaft 25 for rotation with barrels 14 about axis R in the operation of diverter 10 as herein described. Load transmission flange 27 is supported for rotation within thrust bearing 28 at the forward end of bearing housing 19 to receive the muzzle 14*a* ends of barrels 14 and shaft 25 for rotation within bearing housing 19 and to provide a recoil bearing in the operation of the gun 11 and diverter 10 combination. A plurality of air ports 29 may be provided through the walls of bearing housing 19 for added cooling of barrels 14.

Diverter housing 31 may be attached to the forward end of bearing housing 19 using conventional attaching means, and rotatably supports shaft 25 and the rotary deflector of diverter 10. Housing 31 defines a chamber 32 through which sabot fragments and gun gas are diverted and discharged. A rotary deflector (starwheel) 33 is mounted for rotation with support shaft 25 and defines a conical surface of ramp 34 for deflecting sabot fragments radially outwardly; a plurality of axial bores 35 through starwheel 33 are defined for the passage of a penetrator after the sabot has been stripped. Ramp 34 configuration and starwheel 33 placement relative to muzzles 14*a* for optimum operation of diverter 10 is described below, starwheel 33 being disposed in axial spaced relationship to muzzles 14*a* a distance determined empirically from test devices so that substantially all sabot fragments are diverted. One or more exit ports 36 are provided through the walls of housing 31 for discharge of diverted sabot fragments and gaseous products. A backflow gas baffle 37 may be disposed within diverter housing 31 just rearward of exit port(s) 36 to prevent propellant gases from blowing back to barrels 14.

The forward portion of diverter 10 comprises a housing portion 39 defining a chamber 40 into which sabot fragments may be deflected from starwheel 33 in the operation of diverter 10. The rearward end of housing 39 may define a deflector support member 41 into which the forward end of shaft 25 may be journaled for rotation. Housing 39 may also include one or more discharge ports 42 for the discharge of fragments and gun gas from chamber 40. The forward end wall of housing 39 defines a stationary end impact plate 43 disposed at an angle P to axis R in order to deflect sabot fragments and gas through discharge ports 42 preferably located in the lower left quadrant of diverter 10. For example, when viewed forwardly along the gun centerline (axis R), impact end plate 43 may be inclined at 45° to axis R from the 1:30 clock position (45°) forwardly to the 7:30 position (225°). Sabot material and gun gases impact plate 43 and are discharged from the housing 39 at the 7:30 position, diverting material down and to the left of the aircraft.

Exit tube 45 defining an inlet 46 and exit port 47 is supported by end plate 43 for passage of a stripped penetrator fired by gun 11. Starwheel 33 is mounted for rotation in close proximity to exit tube 45 as shown in FIG. 1 to ensure diversion of substantially all sabot fragments from the line of flight of the penetrator.

Figure 2:
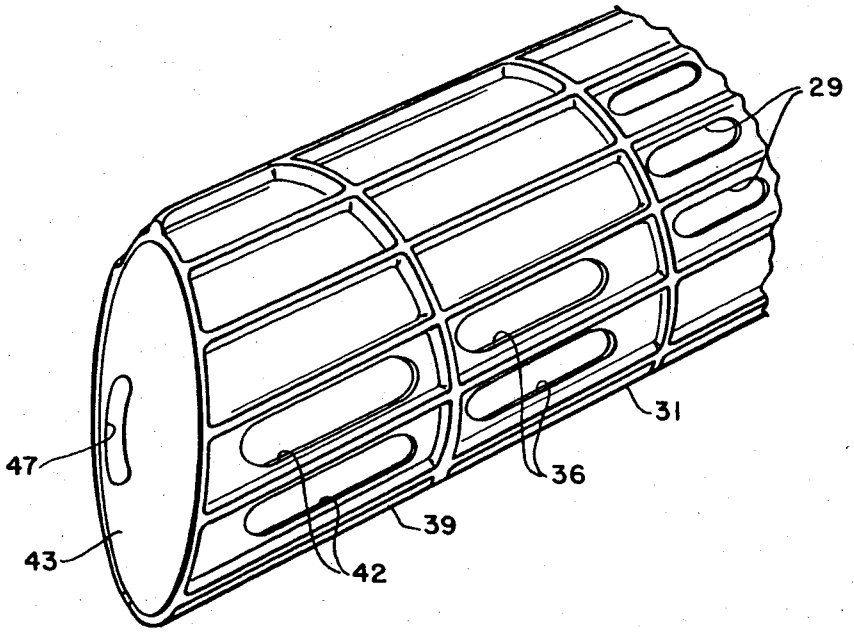
FIG. 2 is a perspective view of the forward portion of the diverter housing.

FIG. 2 is a perspective vew of housing portion 39, end impact plate 43, diverter housing 31, and a portion of torque tube 12 to illustrate schematically the location of projectile exit port 47, discharge ports 42,36, and ports 29.

Figure 3:
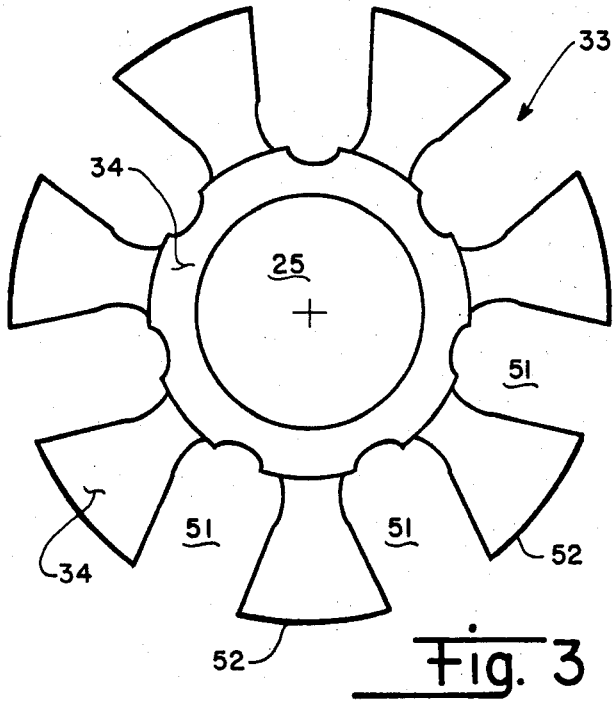
FIG. 3 is an end view of the diverter rotary deflector illustrating its circumferential shape.

Referring now to FIG. 3, shown therein is a rear end view of starwheel 33 as mounted on shaft 25. By reason of the mounting to shaft 25, the rotation of starwheel 33 is fixed relative to the barrels 14 of the Gatling type gun system 11. Slots 51 defined between projections 52 on the periphery of starwheel 33 may comprise the axial bores 35 for passage of a penetrator as discussed above. The width of each slot 51 is sufficient to allow passage of a stripped standard full bore penetrator plus several degrees of yaw. Ramp 34 upon which separated sabot fragments impact in being deflected by starwheel 33 is defined on the surfaces of projections 52 and that portion of starwheel 33 surrounding shaft 25 as in the view of FIG. 3. In the test devices built in demonstration of the invention, optimum diversion of fragment material was obtained for a ramp 34 included at from about 30° to about 35° relative to axis R. Thus, the separating sabot material and expanding gun gases are prevented from proceeding forwardly through exit tube 45, and are deflected by starwheel 33 and impact plate 43 through discharge ports 42 on the bottom and side of housing 39.

Figure 4:
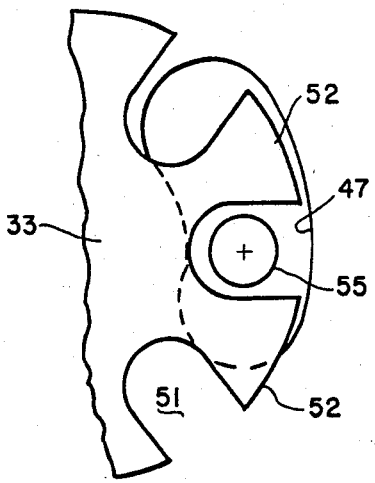
FIG. 4 is a view of a superposition of the rotary deflector and the projectile exit port in registration with the muzzle of a gun barrel.

Referring now to FIG. 4, shown therein is a view of a superposition of starwheel 33 on exit port 47 as viewed along axis R. Exit port 47 approximates a sector of an annulus in shape, and exit tube 45 is of a width comparable to slots 51 in starwheel 33. The projection of exit tube 45 onto a plane perpendicular to axis R sweeps and angle about axis R corresponding to the arc of travel for a barrel 14 during the time from sear release to bolt unlock in the operation of gun system 11. In the firing of a penetrator 55, starwheel 33 and exit tube 45 are brought into registration, as illustrated in FIG. 4, with most of exit tube 45 blocked, resulting in a relatively small effective opening for passage of penetrator 55 thereby effectively preventing the passage of sabot fragments.

Figure 5:
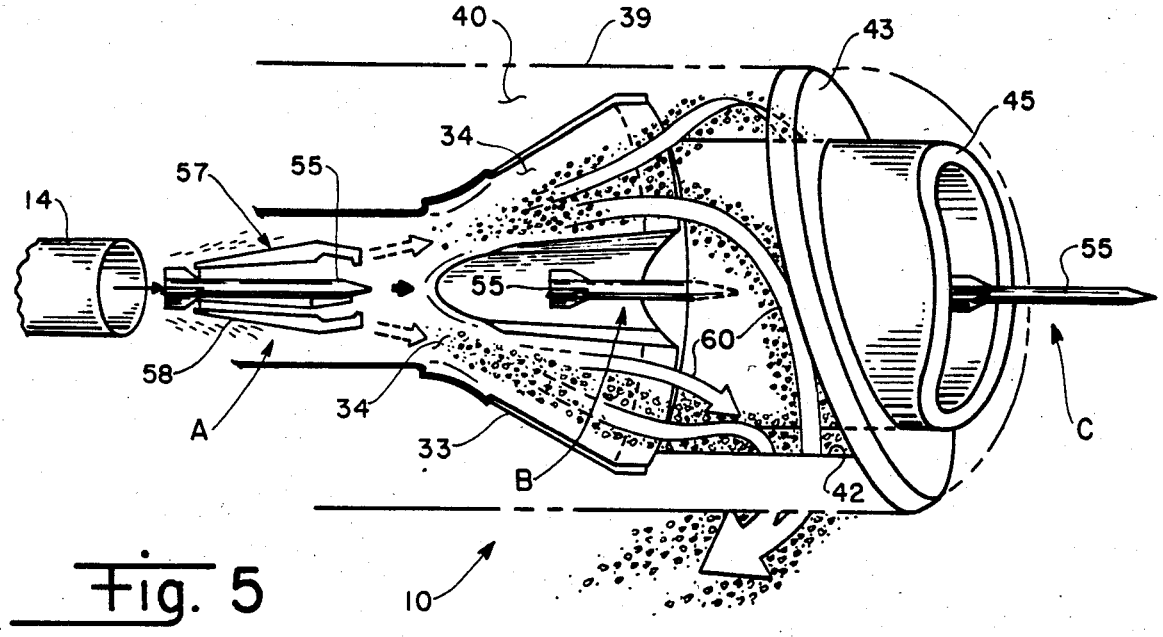
FIG. 5 is a schematic of the diverter of the invention illustrating its operation in the deflection of sabot fragments and gun gas as a projectile is fired.

In the operation of diverter 10 of the present invention, it is necessary that separation of the sabot from the penetrator occur as the projectile exits muzzle 14*a* of gun barrel 14. This may be effected by suitable construction of the sabot, the details of which are outside the scope of this invention, to promote substantial separation from penetrator 55 under centrifugal and/or aerodynamic forces experienced upon firing and induced by rifling spin. FIG. 5 presents an illustration of the basic operation of diverter 10 in the separation and discharge of sabots from a fired projectile. Shown therein are three seriatim positions A,B,C of a projectile 57 in its flight through diverter 10. Projectile 57 comprises penetrator 55 sheathed with a stippable sabot 58, and is shown at position A as just exiting a gun barrel 14 where sabot 58 separates radially outwardly due to the aforesaid forces. Sabot 58 then impacts ramp 34 of starwheel 33, and the fragments are deflected through chamber 40, and off the walls of housing 39, which absorb the outward momentum of the sabot 58 fragments. Forward momentum carries the fragments to the forward impact end plate 43 where the fragments are again redirected while retaining a portion of their forward momentum. The fragments are discharged through port(s) 42 as shown schematically by arrows 60 which indicate flow direction of the gun gas and sabot fragments. At position B penetrator 55 is within exit tube 45 after having sabot 58 stripped therefrom, and at position C penetrator 55 exits diverter 10 through exit tube 45.

The actual interaction of sabots 58 with starwheel 33 does not occur until sabots 58 have adequately separated from penetrator 55 due to spinning forces beyond a diameter approximated by the size of a full caliber round and of the diameter of exit tube 45. The axial spacing between muzzle 14*a* and starwheel 33 must be as large as practical to ensure maximium efficiency of diverter 10. For projectiles 57 used in demonstration of diverter 10 of the invention, the angle of separation of sabots 58 from pentrator 55 was from about 3.25° to about 4°, resulting in an optimum muzzle 14a to starwheel 33 axial spacing of about 12 to 15 inches. Further, the axial spacing between starwheel 33 and inlet 46 of exit tube 45 was kept to a minimum (viz., about 0.25 inch) to prevent discharge of fragments through exit tube 45.

Two test diverters 10 were fabricated to measure operating efficiency and to determine optimum axial spacing between muzzle 14a and starwheel 33. A single shot test device was used for test firing in a GAU-8 gun, lightweight steel penetrators sabotted with unidirectional fiberglass, glass-filled polyester, molded Rynite 545 TM, and carbon-filled 6/6 nylon. Only the fiberglass sabots resulted in an unacceptable amount of material exiting through exit port 47. The tests were performed using witness panels in front of the gun which showed the signature of material escaping forward of the diverter. Calculations on the amount of material escaping were based on a sampling of fragments from a plurality of test shots which were weighed and dimensionally measured. Based on this data, a close approximation of the mass of material escaping through exit port 47 was made, and showed that from about 97.1% to about 99.5% of the sabot material was diverted.

The second test diverter, operated to verify the diversion efficiency of the starwheel design, included a cylindrical housing 39 to provide a smooth flow pattern 60 of gun gases and sabot fragments through chamber 40 (see FIG. 5). The flow pattern was critical in order to determine through which exit ports material predominantly was discharged. The second test diverter proved to be over 99.9 per cent efficient in diverting sabot material at its most effective configuration.

The present invention, as herein described, therefore provides a novel sabot and gun gas diverter of particular application to aircraft mounted guns for diverting substantially all sabot fragments and gun gas away from the gun to prevent damage to the aircraft. It is understood that certain modifications to the invention may be made, as might occur to one with skill in the field of the invention, within the scope of the appended claims. Therefore, all embodiments contemplated hereunder which achieve the objectives of the invention have not been shown in complete detail. Other embodiments may be developed without departing from the spirit of this invention or from the scope of the appended claims.

We claim:

1. A device for diverting and discharging sabot fragments from a rapid fire gun having a plurality of gun barrels rotatable about a central axis and configured to fire strippable sabotted projectiles, comprising:

a. a diverter member mounted forward of said barrels for rotation therewith, said diverter member defining a generally conical, radially outwardly divergent first impact surface from which said fragments are diverted outwardly upon impact thereon;

b. said diverter member including a plurality of axial bores spaced therearound corresponding in number to and respectively coaxial with said plurality of rotatable gun barrels, through which the trajectories of said fired projectiles are defined; and c. means defining a second impact surface attached to said gun and disposed forward of said diverter member for substantially absorbing the forward momentum of said fragments and diverting said fragments from said gun in a predetermined direction relative to said central axis.

2. The device as recited in claim 1 wherein said second impact surface is inclined at about 45° to said axis.

3. The device as recited in claim 1 further comprising:

d. means defining a housing around said diverter member and attached to said gun, said housing defining an internal chamber into which said fragments are diverted from said diverter member;

e. wherein said second impact surface is defined by a forward end wall of said housing, said end wall further defining an exit port for passage of said projectiles from said gun; and f. means defining a opening in said housing for discharging said diverted sabot fragments from said housing in said predetermined direction.

4. The device as recited in claim 1 wherein the size of each said axial bore is selected to correspond essentially to the size of said stripped projectiles.

5. The device as recited in claim 1 wherein the axial spacing of said diverter member relative to the muzzle ends of said barrels is selected to allow substantial separation of a said sabot from a said projectile.

6. The device as recited in claim 5 wherein said axial spacing is from about 12 to about 15 inches.

7. The device as recited in claim 1 wherein said diverter member includes a conical first impact surface inclined with respect to said axis at an angle of from about 30° to about 35°.

8. In a rapid fire multiple barrel rotary gun configured to fire sabotted projectiles and including means defining a sabot stripper for said projectiles fired from said gun, an improvement comprising:

a. a diverter member mounted forward of said barrels for rotation therewith, said diverter member defining a generally conical, radially outwardly divergent first impact surface from which said fragments are diverted outwardly upon impact thereon;

b. said diverter member including a plurality of axial bores spaced therearound corresponding in number to and respectively coaxial with said plurality of rotatable gun barrels, through which the trajectories of said fired projectiles are defined; and c. means defining a second impact surface attached to said gun and disposed forward of said diverter member for substantially absorbing the forward momentum of said fragments and diverting said fragments from said gun in a predetermined direction relative to said central axis.

9. The gun as recited in claim 8 wherein said second impact surface is inclined at about 45° to said axis.

10. The gun as recited in claim 8 further comprising:

d. means defining a housing around said diverter member and attached to said gun, said housing defining an internal chamber into which said fragments are diverted from said diverter member;

e. wherein said second impact surface is defined by a forward end wall of said housing, said end wall further defining an exit port for passage of said projectiles from said gun; and f. means defining a opening in said housing for discharging said diverted sabot fragments from said housing in said predetermined direction.

11. The gun as recited in claim 8 wherein the size of each said axial bore is selected to correspond essentially to the size of said stripped projectiles.

12. The gun as recited in claim 8 wherein the axial spacing of said diverter member relative to the muzzle ends of said barrels is selected to allow substantial separation of a said sabot from a said projectile.

13. The gun as recited in claim 12 wherein said axial spacing is from about 12 to about 15 inches.

14. The gun as recited in claim 8 wherein said diverter member includes a conical first impact surface inclined with respect to said axis at an angle of from about 30° to about 35°.

* * * * *